United States Patent [19]

Bolliger

[11] Patent Number: 4,957,452

[45] Date of Patent: Sep. 18, 1990

[54] ELECTRICAL TERMINAL

[75] Inventor: Roman Bolliger, Muttenz, Switzerland

[73] Assignee: Oskar Wortz & Inhaber Hans Woretz, Muttenz, Switzerland

[21] Appl. No.: 433,997

[22] Filed: Nov. 9, 1989

[30] Foreign Application Priority Data

Dec. 14, 1988 [CH] Switzerland ..... 4613/88

[51] Int. Cl.[5] ..... H01R 4/24

[52] U.S. Cl. ..... 439/410; 439/716; 439/723

[58] Field of Search ..... 439/389, 391, 395, 409, 439/410, 432, 436–441, 777, 796, 372, 716, 723

[56] References Cited

U.S. PATENT DOCUMENTS

| | | | |
|---|---|---|---|
| 4,413,872 | 11/1983 | Rudy, Jr. et al. | 439/387 |
| 4,466,682 | 8/1984 | Jusseau et al. | 439/391 |
| 4,729,738 | 3/1988 | Heng et al. | 439/409 |

FOREIGN PATENT DOCUMENTS

| | | | |
|---|---|---|---|
| 274948 | 7/1988 | European Pat. Off. | 439/409 |
| 2516711 | 5/1983 | France | 439/391 |
| 2136638 | 9/1984 | United Kingdom | 439/409 |

*Primary Examiner*—David L. Pirlot

*Attorney, Agent, or Firm*—Laurence R. Brown

[57] ABSTRACT

The self-stripping electrical terminal includes a casing in which a conductive connector member in form of a U-shaped profile as well as two contact members are located which are pivotable in latter about pivot axes. The conductors which are to be mounted to the terminal can be inserted through lateral openings in the casing into the connector member. Each contact member includes at a radial distance from its pivot axis forked contact parts projecting approximately in the direction of the circle described by the pivoting movement, which contact parts cooperate to cut the insulation of a wire during their pivoting movement and simultaneously push the insulation away and come into the desired conductive contact with the wire.

9 Claims, 1 Drawing Sheet

FIG. 1
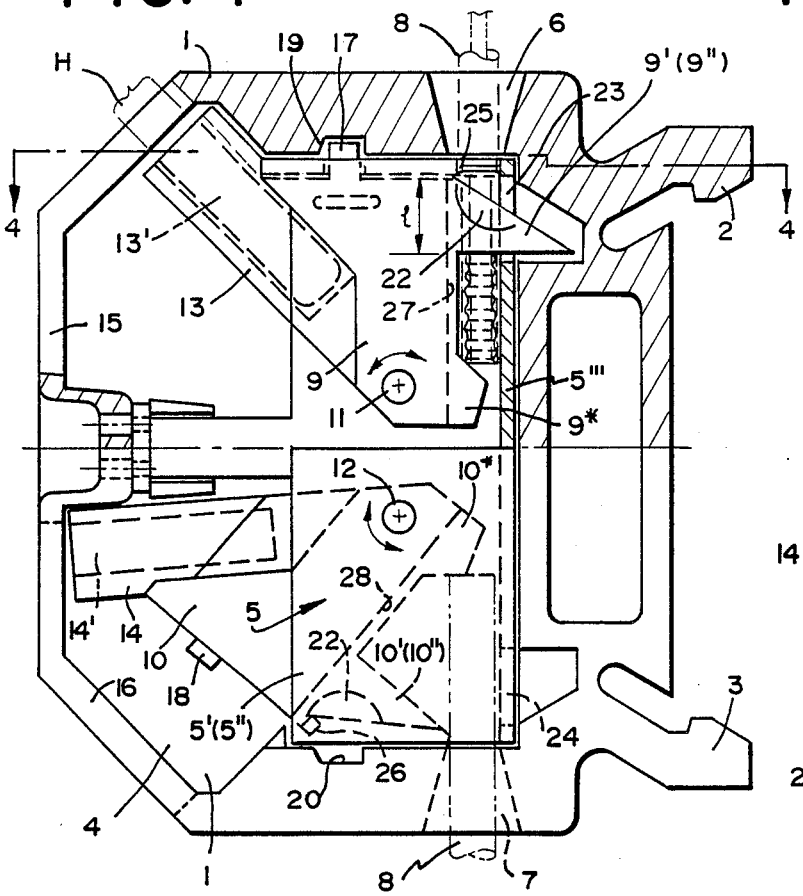
FIG. 2
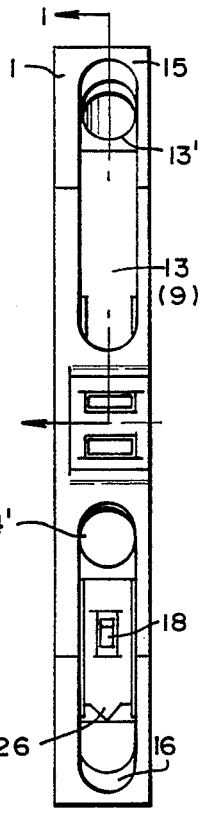
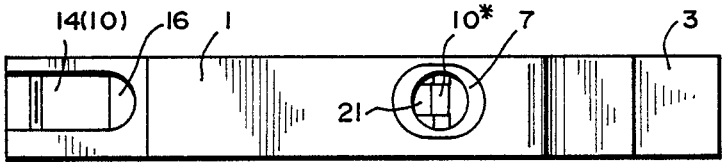
FIG. 3
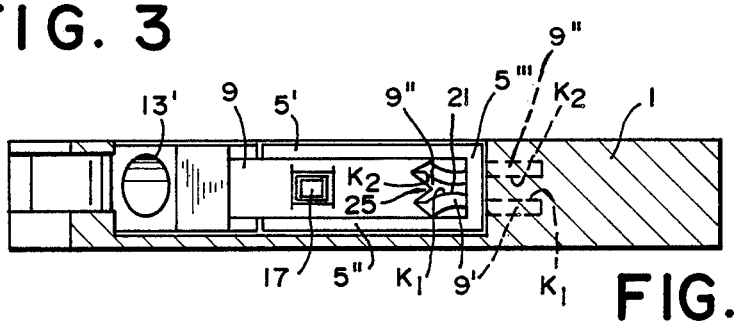
FIG. 4

ELECTRICAL TERMINAL

BACKGROUND OF THE INVENTION

1. Field of the Invention

The present invention relates to an electrical terminal including a casing of an insulating material having openings therein, an electrically conducting connector member for wires inserted through said openings in the casing which connector member is located within the casing, including further electrically conducting contact members acting at the two ends of the connector members and electrically connected thereto, which contact members are arranged to pivot by an operating thereof from the outside of the casing from a inoperative position into a clamping position in which they contact a respective inserted wire possibly after it has been bared and arrested. The invention relates more specifically to a terminal of the kind referred to above in which a preceeding skinning for producing the electrical contact between the terminal and an insulated conductor (wire or stranded wire) is not necessary and allows in spite thereof at an absolute safety the achieving of an impeccable electrical connection.

2. Description of the prior art

An electrical terminal of the kind referred to above is e.g. disclosed in the Swiss Patent Specification No. CH-P 664 647 of this assignee. The insulation cutting unit formed by a stationary slot as disclosed in said specification and forming part of the conductive connector member may, however, not always satisfactory in all cases.

SUMMARY OF THE INVENTION

It is, therefore, a general object of the present invention to provide an electrical terminal by means of which any kind of conductors, but specifically conductors of the design of insulated strands can be connected without any trouble.

A further object is to provide an electric terminal by means of which a preceeding stripping of an insulated wire is not necessary and yet an impeccable electrical connection can be provided.

Still a further object of the invention is to provide an electrical terminal having a connector member which comprises two side walls and a cross-piece interconnecting same such to provide a profile having a U-shaped passage for receipt of the wires to be inserted therein; and in which two contact members are pivotably mounted to the connector member between the side walls to pivot around pivot axes and which contact members comprise forked contact parts arranged each at an end located radially distant from one respective of the pivot axes and projecting approximately in the direction of the circle of the pivoting movement which forked contact parts enclose each a slot in alignement with the passage of the connector member, of which forked contact parts the mutually oppositely located edges are of a knife-like design whereby upon a pivoting of a respective contact member into the clamping position the insulation of a wire inserted into the connector member is cut through by the edges and a part of the cut insulation is pushed away.

Yet a further object is to provide an electrical terminal having pivotable contact members which include forked contact parts extending approximately tangentially to the circular curve described by the pivoting movement which contact parts form simultaneously the cutting unit and which due to their specific arrangement do not only cut the insulation of a wire but additionally displace the insulation relative to the wire proper such to secure an impeccable electrical contact.

A further object is to provide an electrical terminal in which the cross-piece of an U-shaped connector member includes openings through which the ends of the forked contact parts may pass during their pivoting movement into the clamping position such to increase the operative field of traverse of the contact members.

Still a further object is to provide an electrical terminal by means of which an optimal cutting of the insulation and a displacing of the cut off section of the insulation over a distance as large as possible is achieved and at the same time a wire is brought to contact the cross-piece of the connecting member.

BRIEF DESCRIPTION OF THE DRAWING

The invention will be better understood and objects other than those set forth above, will become apparent when consideration is given to the following detailed description thereof. Such description makes reference to the annexed drawings wherein:

FIG. 1 is a side view of the electrical terminal made in accordance with the present invention of which the upper part is illustrated partly in section along the line 1—1 of FIG. 2;

FIG. 2 is a view of the terminal from the left based on FIG. 1;

FIG. 3 is a bottom view of the terminal of FIG. 1; and

FIG. 4 is a top view of the terminal of FIG. 1, partly in section along the line 4—4 of FIG. 1.

DESCRIPTION OF THE PREFERRED EMBODIMENT

The drawings illustrate an electrical line-up terminal which includes a casing 1 of an insulating material and which includes two mounting legs 2 and 3 of a known design for a mounting thereof on a not particularly illustrated supporting bar.

A U-shaped connector member 5 made of metal is located in a recess 4 of the casing 1. Electrical conductors, e.g. insulated stranded wires 8 can be inserted through cone-shaped openings 6 and 7 in the upper and lower, resp. edge of the casing from both sides into the connector member 5.

The connector member 5 includes two side walls 5' and 5'' and a cross-piece 5''' interconnecting same. The inserted wires 8 come to be located between the side walls 5' and 5'' directly above the cross-piece 5'''.

In order to clamp the wires 8 two contact members 9 and 10 are located independently from each other between the side walls 5' and 5'' and arranged to pivot around the pivot axes 11 and 12, resp.

The two contact members 9, 10 are arranged mirror-like relative to the connector member 5 and the pivot axes 11, 12 are respectively located in the area of half the length of the connector member 5.

The contact members 9, 10 include at one end located radially remote from the respective pivot axis two respective contact parts 9', 9'' and 10', 10'', resp. and extend or project, resp. roughly in the direction of the circle of traverse or circle of the pivoting movement, resp. which contact parts 9', 9''; 10', 10'' are intended to be brought into an electrical contact with the wires 8 upon a pivoting of the contact members 9, 10 from a inoperative position (FIG. 1, bottom) into a clamping position (FIG. 2, top) such as will be described further below.

Each contact member 9, 10 consists basically of a conductive material (metal), includes, however, preferably a section 13 and 14, resp. of an insulating material. A recess 13', 14' is present in this respective section of the contact members 9, 10 into which an auxiliary tool (pin, screw-driver) can be inserted through lateral openings 15, 16 of the casing such to pivot the contact members 9, 10.

The bottom part of FIG. 1 of the drawing illustrates the contact member 10 in its inoperative position while the top part illustrates the contact member 9 after its pivoting about roughly 45° out of its inoperative position (corresponding to the bottom part) into its clamping position.

Each contact member 9, 10 includes, furthermore, at the general area of its pivot axis a cam shaped projection 9* and 10*, resp. These projections act as abutment for an inserted wire 8.

In the illustrated embodiment each contact body 9, 10 includes additionally an elastically yielding cam 17 and 18, resp. which in the clamping positions engage into a respective recess 19 and 20, resp. of the casing 1 such to arrest the corresponding contact member in the clamping position once it is seated against an accidental pivoting. An opening of the clamping engagement is however, at any time possible by overcoming the elastic arrest.

The forked contact parts of each pair 9'. 9'' and 10', 10'' resp. extend as already mentioned substantially in the direction of the local curve of the circle described by the pivoting movement. A slot 21 is located between the parts 9', 9'' and 10', 10'', resp. which slot 21 upon a pivoting of the contact members 9 and 10, resp. from the inoperative position into the clamping position comes to lie over the respective wire 8 to be clamped. The inner edges $K_1$, $K_2$ of each contact piece pair located oppositely to each other are of a knife-like design (or operate at least as cutting edges). The contact pieces have, furthermore, the shape of acute tapering teeth (as viewed in the plane of the pivoting movement), i.e. about the shape of acute triangles. Each contact part 9'. 9'' and 10', 10'', resp. in shape of a forked tooth after overcoming of a predetermined resistance spring can yield elastically towards the outside against the inner surface of the side walls of the connector member 5. This ensures that the insulation of a wire will be cut through, indeed, however not the wire itself. The elasticity is preferably achieved in that each contact part includes in an area of its longitudinal extent a section 22 which is domed towards the inner side of the slot. This ensures additionally an optimal clamping of the wire between the contact parts of each pair (additionally, the wire may be also pressed against the cross-piece of the connector member 5).

Furthermore, recesses 23 and 24, resp. are provided in said cross-piece of the connector member 5 through which the free end portions of the contact parts 9', 9'' and 10', 10'', resp. can pass prior to reaching the clamping position. This leads to an optimal stripping of the conductors, i.e. wires.

Due to the inventive design of the contact parts the insulation is not only cut along a line of separation but the severed part of the insulation is also simultaneously displaced (by the distance which is travelled by the cutting edges of the contact pieces during the cutting of the insulation relative to the longitudinal axis of the wire, such as illustrated in FIG. 1). This leads to an optimally stripped wire contact surface such that any kind of conductors, specifically also stranded wires can be clamped at an impeccable electrical connection.

It shall be repeated that by the pivoting of the contact members and their contact parts, resp. from the inoperative position into the clamping position the insulation of the conductor or wire, resp. is cut through and at the other hand the insulation is simultaneously displaced whereafter the contact parts contact the blank wires and establish at the same time the contact to the connector member. The contact parts of an elastic material in the otherwise rigid connector member ensure an elastic contact which maintains a permanent contact pressure, also when e.g. a stranded wire adjusts itself to the shaping. The tips of the contact pieces which preferably in the clamping position project through the recesses in the cross-piece allow a tight embracing of the wire and prevent furthermore, a spreading of the tips.

Arresting or clamping, resp. means is in form of a tooth 25 and 26, resp. and/or in form of a clamping bar 27 and 28, resp. for an inserted wire arranged on the contact members 9 and 10, resp. in the area of the slot 21 between the contact parts 9', 9'' and 10', 10'', resp. and specifically at the rear end of latter. By means of such the conductor 8 is clamped additionally between these means and the cross-piece 5'' with or without insulation.

It shall, finally be noted that the path of the electric current is led from the stripped part of the wire via the contact parts 9', 9'' and 10', 10'' abutting the wire elastically into the side walls of the connector member 5 which are also abuttingly contacted by the contact parts.

While there is shown and described a present preferred embodiment of the invention, it is to be distinctly understood that the invention is not limited thereto, but may be otherwise variously embodied and practiced within the scope of the following claims.

I claim:

1. An electrical terminal including a casing of an insulating material having two openings, therein, and electrically conducting connector member for ends of two wires inserted through said two openings in said casing which connector member is located in said casing, including further electrically conducting contact members acting at the two end of said connector member and electrically connected thereto, which contact members are arranged to pivot over a movement arc operation thereof from the outside of said casing from a inoperative position into a clamping position in which they contact a respective inserted wire and retain it, said connector member comprising two side walls and a cross-piece interconnecting the two side walls such to provide a profile having a U-shaped passaged for receipt of the wire ends to be inserted therein; which two contact members are each pivotably mounted to said connector member between said side walls to pivot a around pivot axis and which contact members comprise two forked contact parts arranged each at an end located radially distant from one respective of said pivot axes and projecting approximately in about said movement arc, which forked contact parts enclose each a slot in alignment with said passage of the connector member, and include forked contact parts with mutually oppositely located edges of a knifelike design whereby upon a pivoting of a respective contact member into said clamping position the insulation of a wire end inserted into said connector member is cut through by said edges and a part of the cut insulation is pushed away.

2. The electrical terminal of claim 1, in which elastically yielding means for arresting said contact members in their clamping position against an accidental pivoting are provided to be operative between said casing and said connector member, respectively at the one hand and said contact members at the other hand.

3. The electrical terminal of claim 1, in which said interconnecting cross-piece of said U-shaped connector member includes openings through which the ends of said forked contact parts may pass during their pivoting movement into the clamping position such to increase the length of said movement arc.

4. The electrical terminal of claim 1, in which said forked contact parts comprise in the plane of traverse the shape of pointed teeth such as acute triangles.

5. The electrical terminal of claim 1, in which said contact members include approximately at the location of said slot at a rear end of said contact parts means for arresting or clamping, respectively an inserted wire.

6. The electrical terminal of claim 1, wherein said pivotable contact members include recesses and said casing includes lateral openings whereby an auxiliary tool may be inserted through said lateral openings into said recesses for the pivoting of said contact members.

7. The electrical terminal of claim 6, in which the casing which includes said recesses for receipt of said tool consists of an insulating material.

8. The electrical terminal of claim 1, in which said forked contact parts are structured at the area of the slot between the respective contact part pair as elastically yielding members in the opening direction thereof.

9. The electrical terminal of claim 8, in which each contact part includes at an area of its length a section which is domed towards said slot.

* * * * *